US005400494A

United States Patent [19]

Stilley

[11] Patent Number: 5,400,494

[45] Date of Patent: Mar. 28, 1995

[54] METHOD OF MANUFACTURING A WHEELED GARMENT BAG

[76] Inventor: Russell L. Stilley, 1113 Abrams Rd., Apt. 261, Richardson, Tex. 75081

[21] Appl. No.: 154,583

[22] Filed: Nov. 18, 1993

Related U.S. Application Data

[62] Division of Ser. No. 24,511, Mar. 1, 1993, Pat. No. 5,353,900.

[51] Int. Cl.[6] ..... B23P 11/00

[52] U.S. Cl. ..... 29/434; 29/454

[58] Field of Search ..... 29/434, 436, 454; 190/18 A, 122; 206/287.1; 280/37, 652

[56] References Cited

U.S. PATENT DOCUMENTS

| | | | |
|---|---|---|---|
| 2,862,586 | 12/1958 | Davis | 190/43 |
| 3,139,164 | 6/1964 | Koffler | 190/43 |
| 3,613,843 | 10/1971 | Davis | 190/50 |
| 4,027,754 | 6/1977 | Walker | 190/18 A |
| 4,030,768 | 6/1977 | Lugash | 280/47.17 |
| 4,062,429 | 12/1977 | Tabor et al. | 190/18 A |
| 4,087,102 | 5/1978 | Sprague | 280/37 |
| 4,215,769 | 8/1980 | Kuc | 190/18 A |
| 4,256,320 | 3/1981 | Hager | 280/37 |
| 4,262,780 | 4/1981 | Samuelian | 190/18 A |
| 4,284,286 | 8/1981 | Lewallen | 280/30 |
| 4,354,583 | 10/1982 | Walker | 190/18 A |
| 4,383,141 | 5/1983 | Walker | 190/18 A |
| 4,406,353 | 9/1983 | Walker | 190/18 A |
| 4,411,344 | 10/1983 | Walker | 190/18 A |
| 4,442,927 | 4/1984 | Walker | 190/18 A |
| 4,538,709 | 9/1985 | Williams et al. | 190/18 A |
| 4,813,520 | 3/1989 | Lin | 190/107 |
| 4,979,598 | 12/1990 | Verheij et al. | 190/18 A |
| 4,995,487 | 2/1991 | Plath | 190/18 A |
| 4,998,603 | 3/1991 | Nordstrom | 190/18 A |
| 5,060,795 | 10/1991 | Bomes et al. | 206/279 |
| 5,113,982 | 5/1992 | Pulichino et al. | 190/18 A |
| 5,113,983 | 5/1992 | Workman | 190/127 |
| 5,181,590 | 1/1993 | Carpenter et al. | 190/18 A |
| 5,242,189 | 9/1993 | Osaki | 280/652 |

FOREIGN PATENT DOCUMENTS

| | | |
|---|---|---|
| 8810556 | 9/1988 | Germany . |
| 8702561 | 5/1987 | WIPO . |
| 9010398 | 9/1990 | WIPO . |

OTHER PUBLICATIONS

Skyway advertising brochure, date unknown.

*Primary Examiner*—Mark Rosenbaum
*Assistant Examiner*—David P. Bryant
*Attorney, Agent, or Firm*—Richards, Medlock & Andrews

[57] ABSTRACT

A folding garment bag including flexible inner and outer cover panels, an internal pivotal frame mechanism, and a handle extendable from inside the bag to full extension for pulling in a direction of minimum width. The garment bag can be tightly folded and bound for compact stowing, or released, whereupon the frame mechanism is spring loaded to force the folded halves of the bag apart in an inverted V-shape configuration. The frame mechanism includes wheels protruding beyond the cover panels for wheeled transport.

10 Claims, 11 Drawing Sheets

METHOD OF MANUFACTURING A WHEELED GARMENT BAG

RELATED APPLICATION

This is a divisional patent application of U.S. patent application Ser. No. 08/024,511, filed Mar. 1, 1993, now U.S. Pat. No. 5,353,900.

TECHNICAL FIELD OF THE INVENTION

The present invention relates in general to garment bags, and more particularly to a garment bag having wheels, an interior frame, and an extendable handle.

BACKGROUND OF THE INVENTION

Conventional soft sided garment bags are widely used by airline passengers because of convenience, as compared to hard sided luggage. The reasons for this are that folding softsided luggage is usually less expensive than hard sided luggage, lighter in weight, the overall thickness of the bag is only as thick as the amount of garments contained therein, the clothes only have to be folded once, such luggage can be easily carried on an airplane and placed in an overhead bin and doesn't have to be checked. The soft sided type of garment bags are structured to be carried by handle or by a shoulder strap. When travelers take advantage of the fact that the garment bag expands to hold all that can be stuffed therein, the bag and contents can often weigh 30–40 pounds. A bag of this weight makes it difficult to carry long distances with the handle or strap. Most conventionally available hard sided luggage has the advantage of wheels and handle devices for easy pulling behind the traveler. To date, garment bags have not been designed to accommodate wheels or towing type handles. Herein lies the need for a lightweight luggage device that combines the advantages of a garment bag noted above, and the portability of a wheeled hard sided luggage case.

Attempts to add wheels and handles to the garment bag have resulted in devices that solve some problems but add others. For example, U.S. Pat. Nos. 4,538,709 to Williams et al., 4,062,429 to Tabor et al., and 4,030,768 to Lugash, require travelers to push the garment bag upright in an unfolded position. The disadvantages are:

It requires that the bag be steered forward. Most travelers have found that pulling a piece of luggage behind them is easier than pushing luggage because no side to side manipulation or steering is needed for pulling.

These bags are also structurally complicated in terms of the number and complexity of additional parts required to provide the wheeled support and handle mechanism.

In addition to the patents identified above, U.S. Pat. Nos. 4,383,141 and 4,354,583, both issued to Walker, have the disadvantages:

This bag structure raises the center of gravity, thus placing more weight on one's hand when moving the bag.

When these bags are left standing alone they are more easily tipped over than a folded garment bag with a lower center of gravity. This makes it inconvenient to the traveler when stopped at a ticket counter, shop, or rest room.

With respect to U.S. Pat. Nos. 4,538,709 to Williams et al. and 4,062,429 to Tabor et al., the bags described therein are pushed forward with the full width of the bag facing the oncoming travelers. The wider a bag one is trying to push through a crowded airport, the more difficult it is to negotiate crowded areas. It is more difficult to maneuver through tight doorways, rest rooms, shops, and will not allow the traveler to wheel the bag down the narrow aisle of an airplane.

Other attempts to add wheels, handles, or frames to the garment bag are disclosed in U.S. Pat. Nos. 4,442,927, 4,411,344, 4,406,353, 4,383,141, all issued to Walker. All of these bags are pulled behind the traveler and have the same problem in that the bags are pulled in the direction of the maximum width instead of the narrowest width. In addition to, this there are other major drawbacks:

Some of the bags are pulled using a strap for a handle. This causes the wheeled garment bag to pull in towards the feet of the traveler, thus constantly bumping into the traveler's heel.

The bags are pulled with the width centered directly behind the traveler. This will also cause the bags to bump into the traveler's heel while walking.

Additionally, when carrying multiple bags, travelers have tried to stack baggage pieces on a folding luggage cart and secure the bags with an elastic type cord. The disadvantage of this is that:

When passing through a security checkpoint the entire load must be disassembled and individually passed through the checkpoint and then reassembled. Similarly, upon boarding an airplane the same sequence must take place with the use of a separate cart that results in additional apparatus that must be carried and stowed away. Sometimes this additional piece is not allowed on board.

Attempts have been made to provide a single piece of luggage that has a self-contained wheeling apparatus and that can be wheeled on an airplane and put in an overhead bin. These bags are shown in U.S. Pat. Nos. 5,116,289 to Pond et al., 4,995,487 to Plath, 4,792,025 to Thomas, and 4,254,850 to Knowles. The disadvantages with these types of apparatus are:

Since the overall storage dimensions are smaller than a garment bag, suits or dresses must be folded many times or rolled up in a spiral fashion. This creates creases in the garments and results in an unsightly appearance.

Also, a disadvantage with all the above mentioned apparatus is that extra parts or complicated parts must be added that would allow additional luggage to be carried on it.

It is against this general background that the present invention has evolved.

Accordingly, several objects and advantages of the present invention are:

- To provide a garment bag that is pulled from behind, thus eliminating the need to be pushed and thus steered.
- To provide a garment bag that requires a minimum number of parts, is cost effective, and easy to manufacture.
- To provide a lower center of gravity thus making the garment bag easier to manipulate.
- To provide a garment bag that is stable and will not fall over when pulling, turning corners or when left alone.
- To provide a garment bag that is wheeled so that the bag rolls in the direction of its minimum width, thus also making it easier to maneuver through tight doorways, rest rooms, shops, and down an aisle of an airplane.

To provide a garment bag that has a stiff pulling handle that keeps the bag away from the traveler's heels when being pulled.

To provide a garment bag that has a handle that will keep the bag positioned off to one side of the traveler, thus also helping to keep the bag away from the traveler's heels when walking.

To provide a garment bag that has a self-contained wheeled apparatus for transporting itself.

To provide a garment bag that allows clothes such as suits and dresses to be folded a minimal number of times.

To provide a garment bag that allows other pieces of luggage to be attached to it without adding extra apparatus such as hooks or complicated strap mechanisms.

SUMMARY OF THE INVENTION

In accordance with the principles and concepts of the invention, a frame infrastructure is integrated into a soft garment bag for allowing the folded halves to be compactly bound together and stowed, as well as released so that the halves of the garment bag spring apart into an inverted V-shaped configuration. Two or more wheels protrude through the garment bag for easy wheeled transport in a direction of minimum width. A telescopic handle can be extended from within the folded portion of the garment bag and locked so that the bag can be easily pulled behind a person. In the release configuration, where the folded bag is in the inverted V-shape, the halves of the bag are spring biased apart so that the bag is upright and remains in a stable configuration for pulling, and the bag does not lean from side to side when pulled around sharp corners. Further, in the towing configuration, the bag can be pulled down narrow aisles, such as in airplanes, and then can be quickly folded into a tight configuration, the handle can be easily retracted within the bag, and stowed in an overhead bin.

The frame infrastructure of the garment bag of the invention includes a pair of U-shaped tubular members that are routed about the periphery of each of the halves of the garment bag, and connected to a rigid plate support at a location where the bag is normally folded. The U-shaped tubular members are hinged to the plate member, and spring biased apart. The hingable connection of the U-shaped tubular members to the, plate support allows the bag to be compactly folded together and bound with Velcro-equipped straps, or completely unfolded and hung by a hangar or to remove the clothing therefrom. For towing, the Velcro-equipped straps can be loosened, whereupon the spring-biased U-shaped tubular members spring apart to the extent allowed by the straps. When the straps become taut, the garment bag is in an inverted V-shape so that it can be pulled with the wheels protruding through the bottom of the halves of the garment bag.

BRIEF DESCRIPTION OF THE DRAWINGS

Further features and advantages will become apparent from the following and more particular description of the preferred and other embodiments of the invention, as illustrated in the accompanying drawings in which like reference characters generally refer to the same parts, functions or elements throughout the views, and in which.

DETAILED DESCRIPTION OF THE INVENTION

Figure 1A:
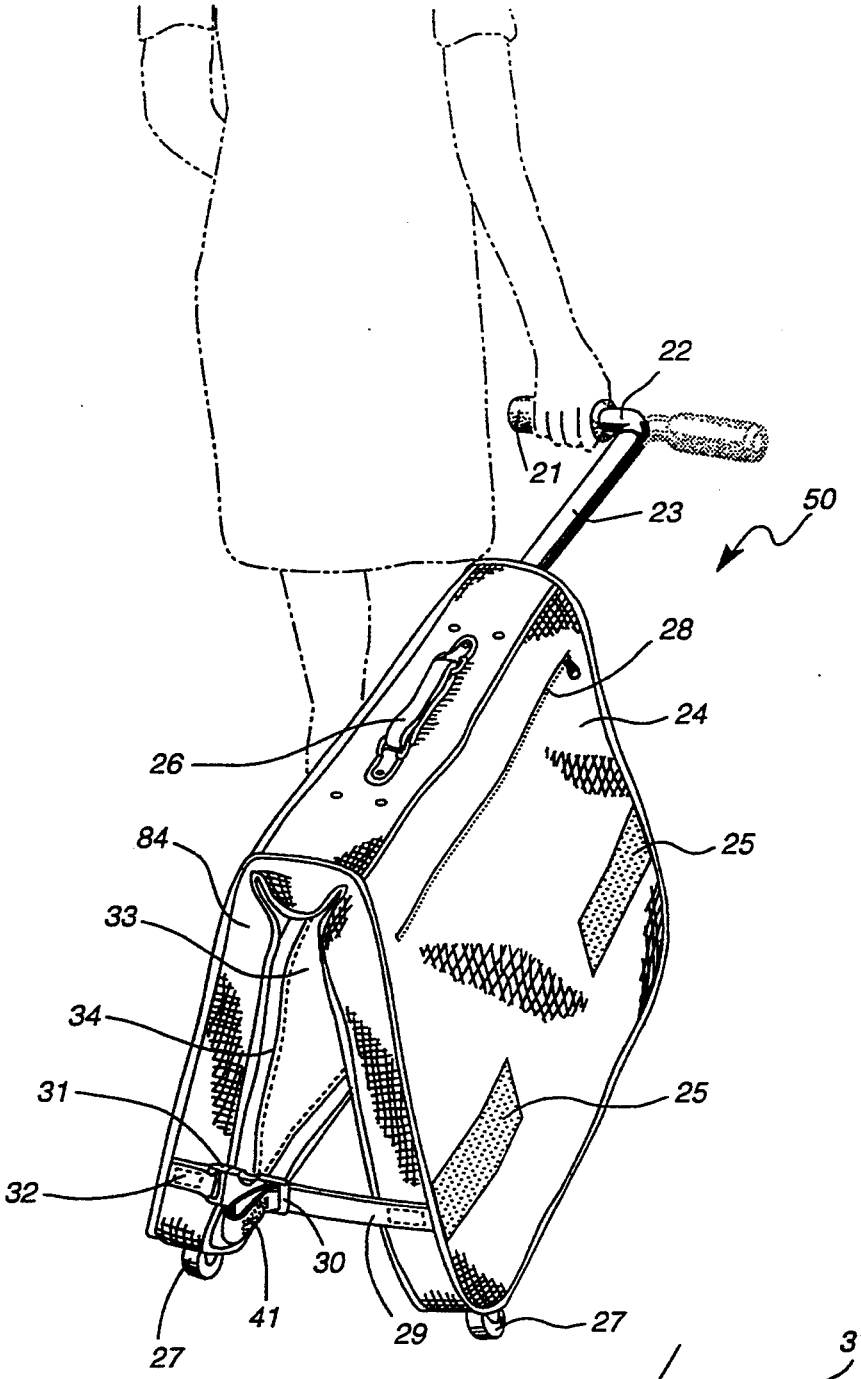
FIG. 1*a* is a perspective view of the wheeled garment bag configured in an inverted V-shape, and being pulled in a direction of minimum width.
Figure 2:
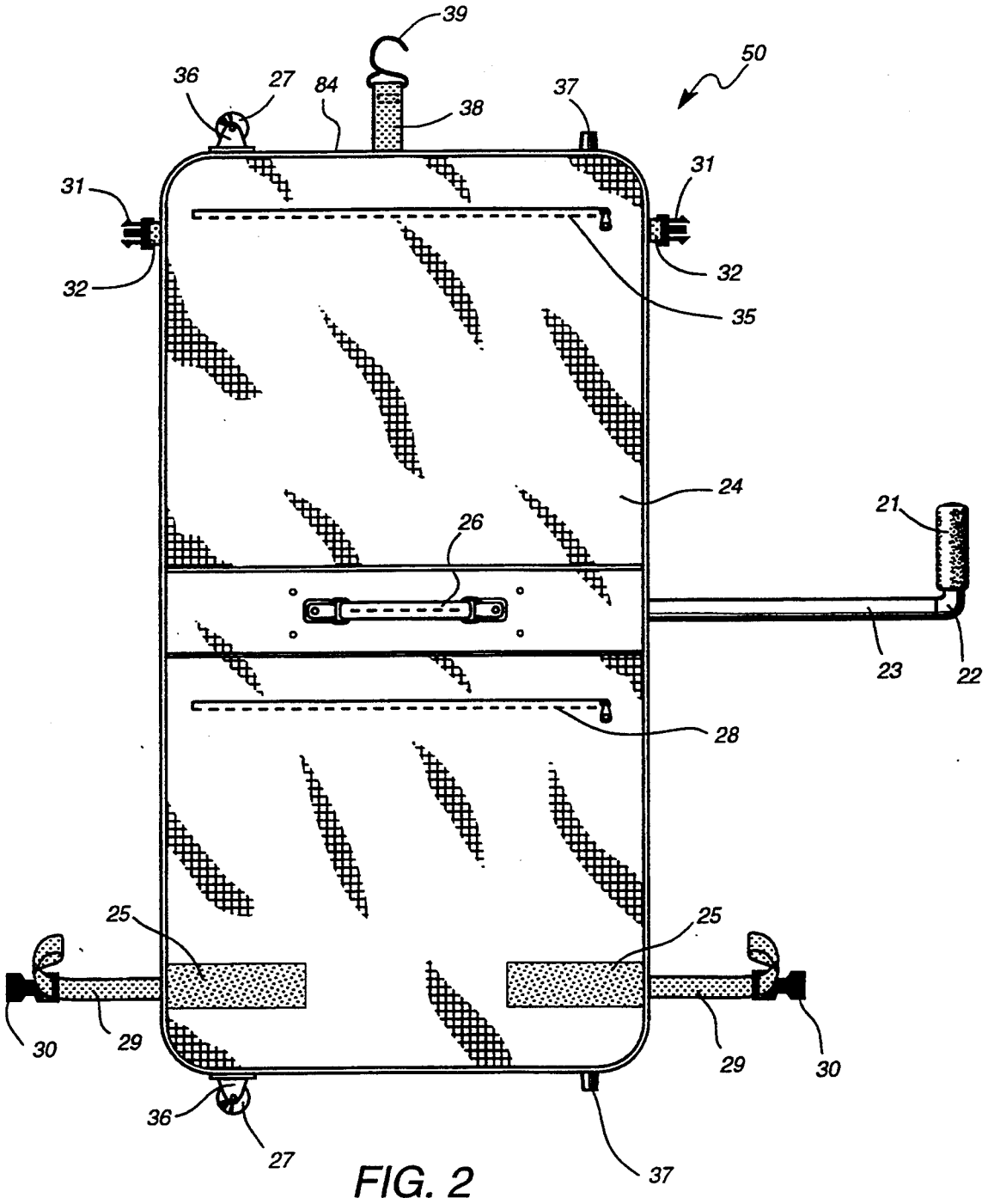
FIG. 2 is a plan view of the exterior of the garment bag in an unfolded position, with the telescopic handle extended.
Figure 4:
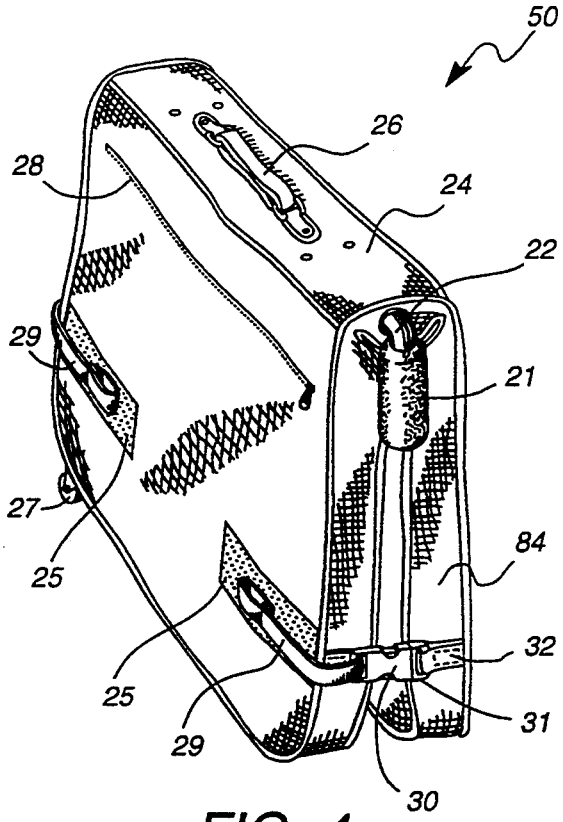
FIG. 4 is a perspective view of the folded garment bag in a compact position for storage.
Figure 5:
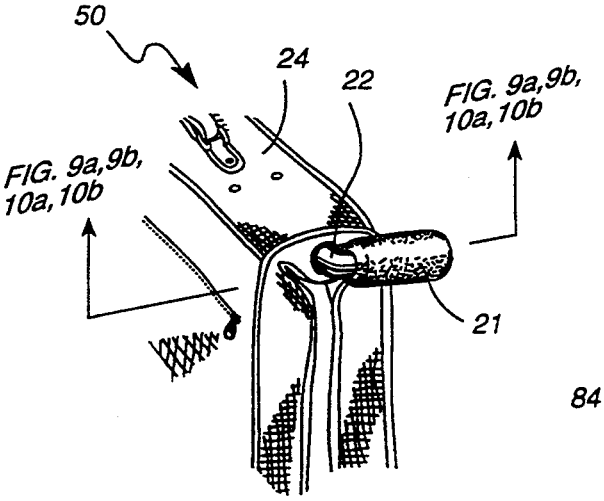
FIG. 5 is a fragmentary perspective view of a portion of the folded garment bag showing the cross section used in FIGS. 9*a*, 9*b*, 10*a*, and 10*b;*

Referring now to FIG. 1*a*, a garment bag 50 of the present invention includes an outer soft panel 24 and an inner soft panel 33, each sewn along the edges to an edge panel 84. The outer panel 24, inner panel 33, and edge panel 84 are formed of suitable fabric material, such as nylon, so that the garment bag 50 can be folded in half for traveling, as shown in FIG. 1*a*, or compactly for storage as shown in FIG. 4. A handle 26 is attached to the middle of the outer panel 24 for grasping and lifting the garment bag 50. As illustrated in FIG. 2, outer panel 24 includes a zipper 35 and a zipper 28 to allow access to pockets that can be used for holding articles therein.

Figure 1B:
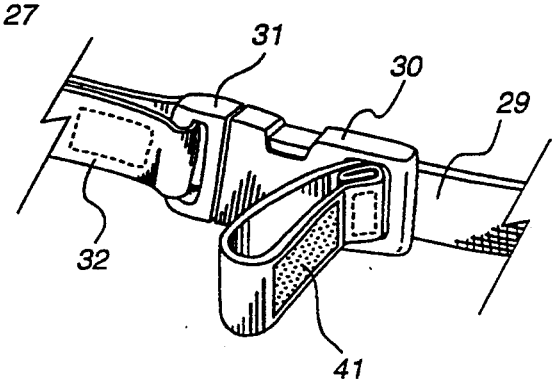
FIG. 1*b* is an enlarged fragmentary view showing a catch and loop mechanism for holding the garment bag in the configuration shown in FIG. 1*a;*

Shown in FIGS. 1*a*, 1*b*, 2, and 4, a nylon strap 32 is sewn to the edge panel 84 and looped through a male plastic catch 31. Also sewn to the edge panel 84 is a long end strap 29 that is threaded through a slot in a female plastic catch 30. The male and female plastic catches 30 and 31 are of convention construction that are matable together for locking, and are releasable. Female plastic catch 30 can slide between the sewn end of the long end strap 29 and the opposite end that is sewn in a loop that functions as a stop, as seen in FIG. 1*b*. Sewn to the loop end of the long end strap 29 is a Velcro hook fastener 41. Sewn to outer panel 24 of the bag are two Velcro loop fasteners 25. This arrangement allows the Velcro fastener 41 on the end of the long end strap 29 to hold both ends of the garment bag 50 tightly together for storage, when the female plastic catch 30 and the male plastic catch 31 are snapped together as shown in FIG. 4. This locking and strap arrangement is duplicated on both sides of the garment bag 50.

Figure 3:
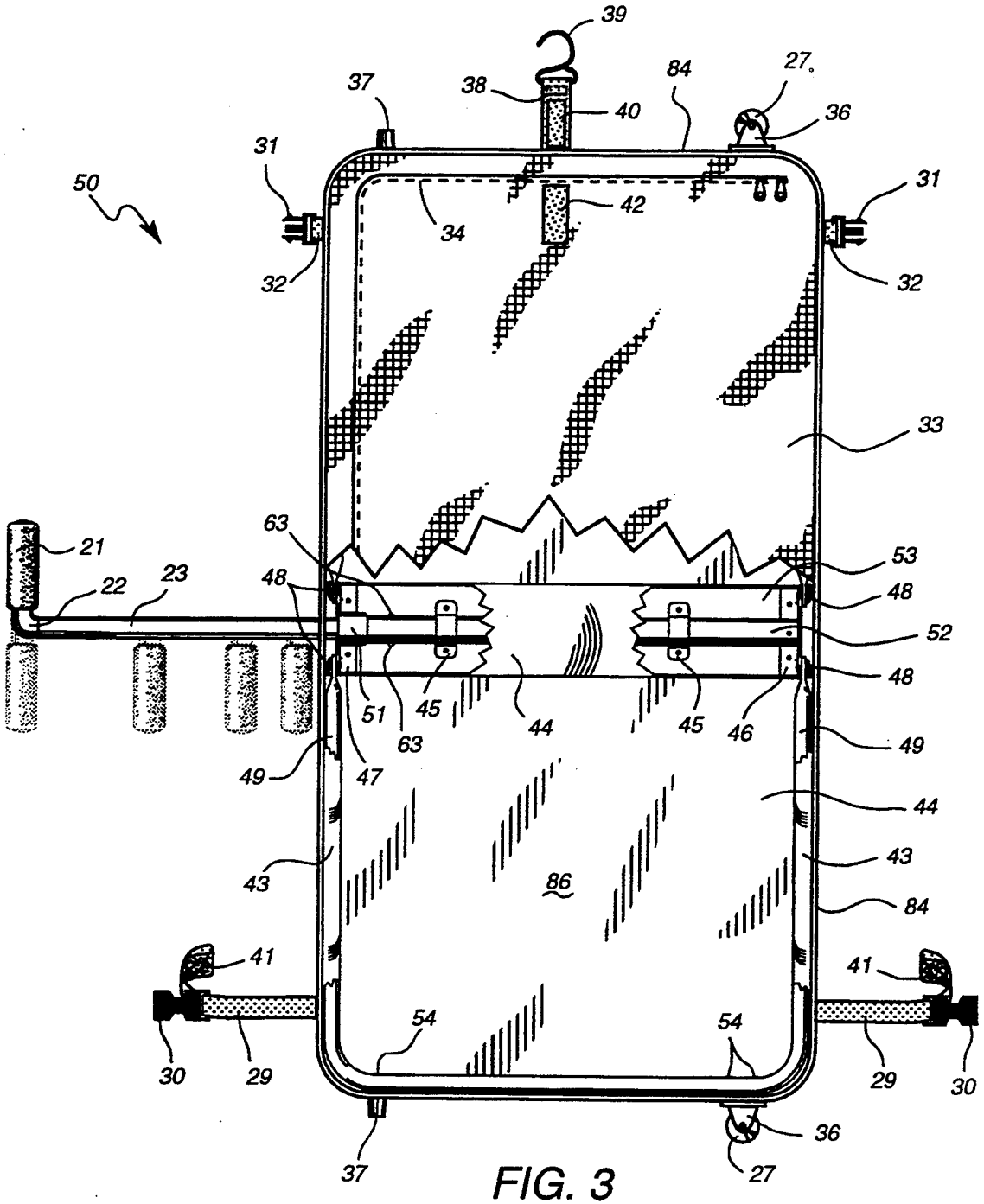
FIG. 3 is a plan view of the interior of the garment bag in an unfolded position, with a cutaway view showing the interior mechanism, and showing various positions of the telescoping handle.

FIG. 3 shows an interior plan view of garment bag 50 with a partial cutaway area exposing the inner parts along the middle section where the bag is folded. Sewn in an inner panel 33 is a zipper 34 that allows access to an inner packing space 86. Sewn around a U-shaped tubular frame 49 and edge panel 84 is a hanger strap 38 that is looped and sewn around a hanger hook 39. Sewn to the hanger strap 38 is a Velcro fastener 40. When not using the hanger hook 39 to hang garment bag 50, the Velcro fastener 40 can be attached to a matable Velcro fastener 42 for storing the hanger 39 out of the way. Fastened to the inside of the garment bag 50 are one or more hangers from which garments can be suspended. Preferably, the internal hangers can be attached to the internal liner and therethrough to the U-shaped tubular frame 49. A substantial load of the garments is thus supported by the frame infrastructure of the garment bag.

FIGS. 3, 6*a*, 7 and 8 show cutaway views of the garment bag 50 frame mechanism. A soft liner 44 is sewn to the inside of outer panel 24 and is used to form the pockets that can be accessed by zippers 35 and 28 (FIG. 2). The liner 44 is also used to cover an outer telescopic tube 52, supporting brackets 45, a front angle bracket 47, a rear angle bracket 46, springs 48, an exterior plastic cap 51, and a stiffener plate 53. Another liner 43 is sewn to the inside of edge panel 84 and is used to cover the tubular frame member 49.

In order for the garment bag 50 to be pulled or towed, a wheel 27 and an associated support bracket 36 (FIG. 6*a*) are mounted by rivets 54 on the rear corners of the left and right tubular frame members 49. The tubular frame 49 can be constructed of either a lightweight tubular, solid metal or plastic rod. Mounted on the front of each tubular frame member 49 is a plastic bumper 37. The bumper 37 is connected to frame member 49 through the edge panel 84 via a rivet 34 (FIG. 3).

Figure 6A:
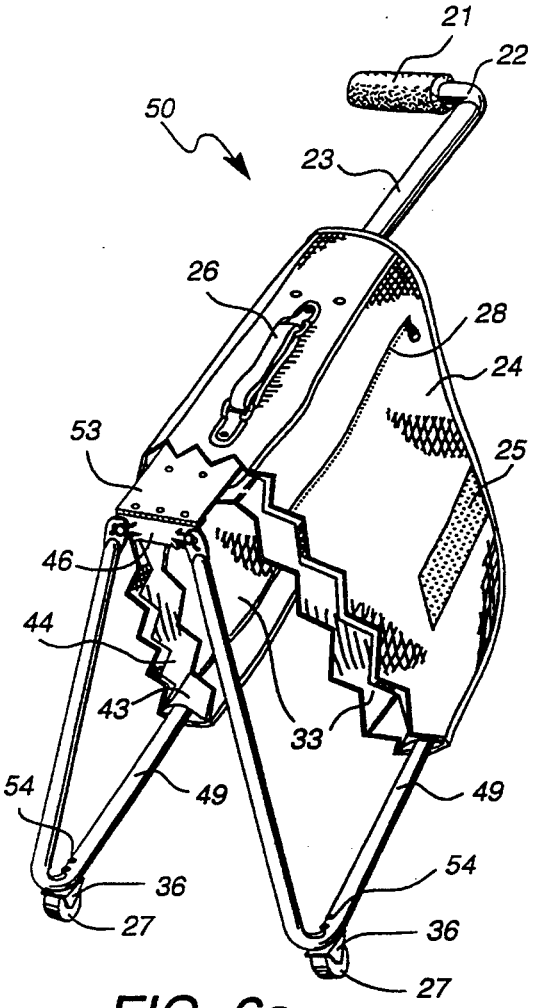
FIG. 6*a* is a perspective view of the folded garment bag in a partially opened position, with the soft cover partially removed to illustrate the tubular frame.
Figure 6B:
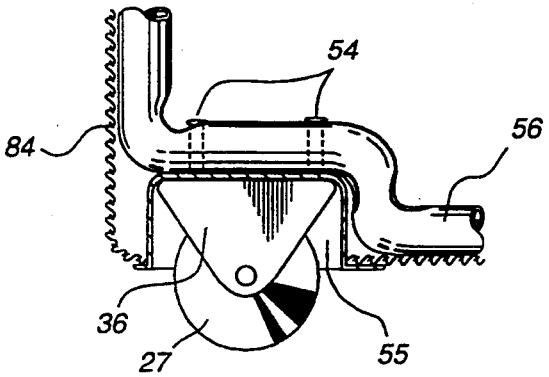
FIG. 6*b* is an enlarged fragmentary plan view showing an alternative for mounting recessed wheels to the tubular frame.

As an alternative for mounting the wheel 27, as shown in FIG. 6*b*, the wheel 27 can be recessed in the frame to allow a longer garment bag 50. This is accomplished by mounting the wheel 27 and associated support bracket 36 through holes in a plastic wheel housing 55 in a recessed part of the frame 56. Rivets 54 are used to mount the parts together.

FIG. 3 illustrates a plastic handle 22 and associated foam handgrip 21 mounted to a inner telescoping tube 23. The inner telescoping tube 23 slides inside the outer telescoping tube 52. The telescoping tube 23 is fully extended and rotated into various positions shown in FIG. 3. The inner telescopic tube 23 will lock in two places 180 degrees apart with respect to outer tube 52 by way of a catch button 63.

Figure 7:
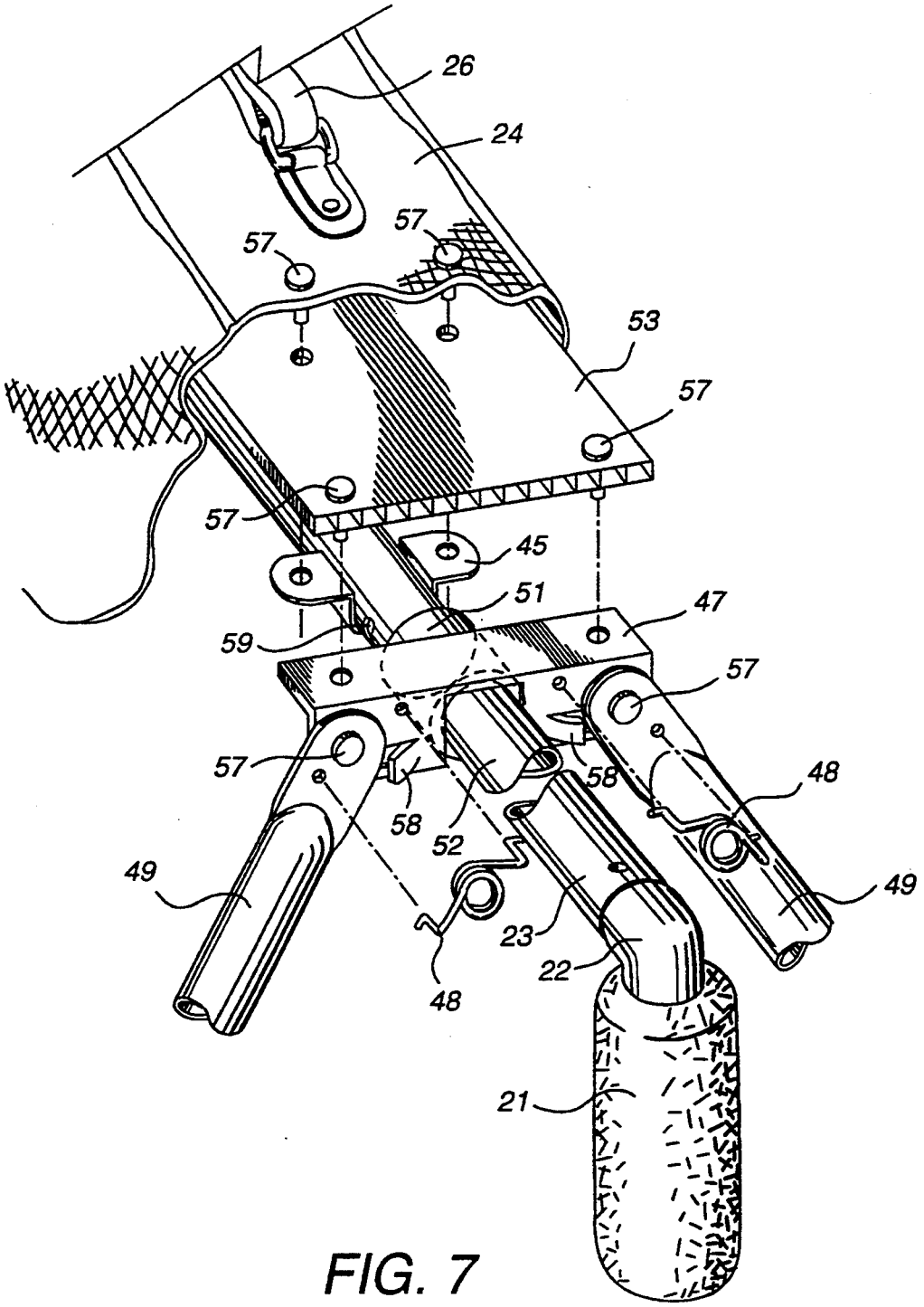
FIG. 7 is an enlarged exploded view showing a portion of the frame mechanism as viewed from the handle end.
Figure 9A:
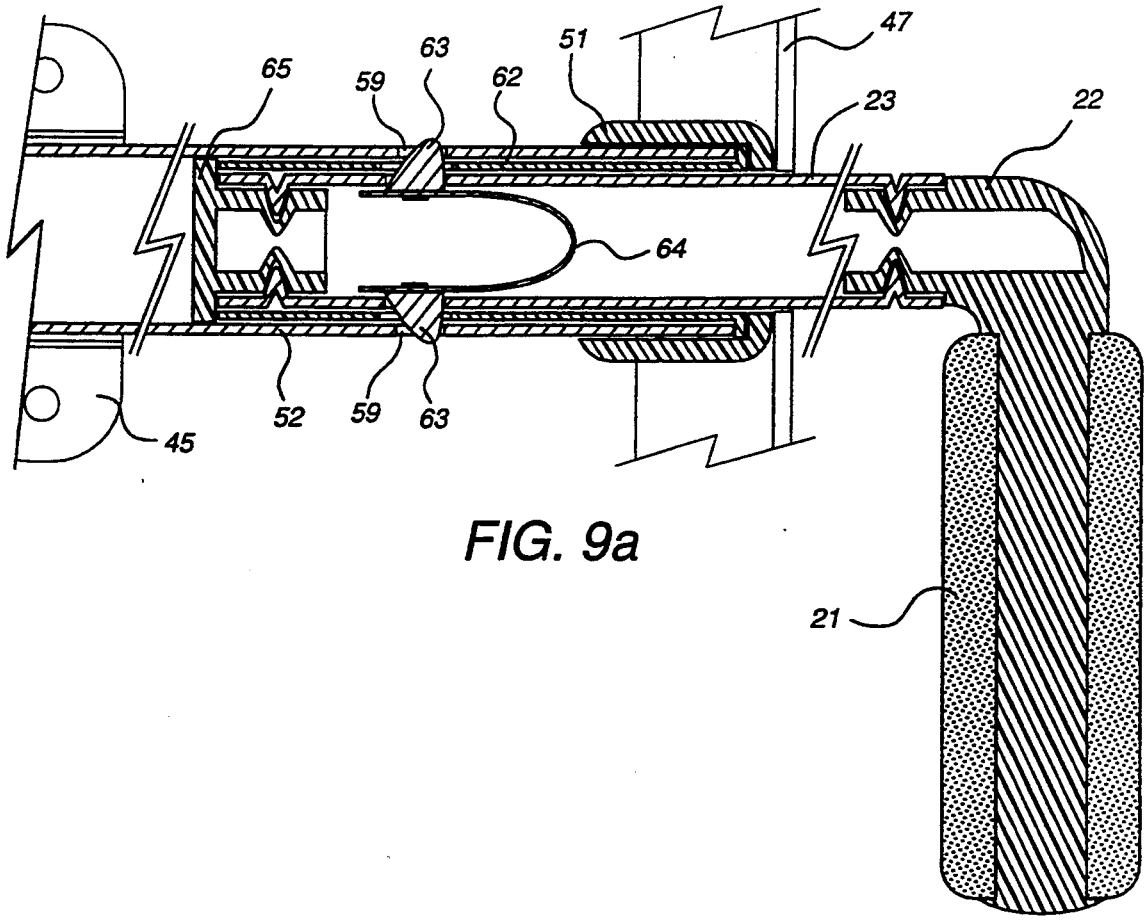
FIG. 9*a* is an enlarged partial cross section showing the locking telescopic tubing and handle mechanism.
Figure 9B:
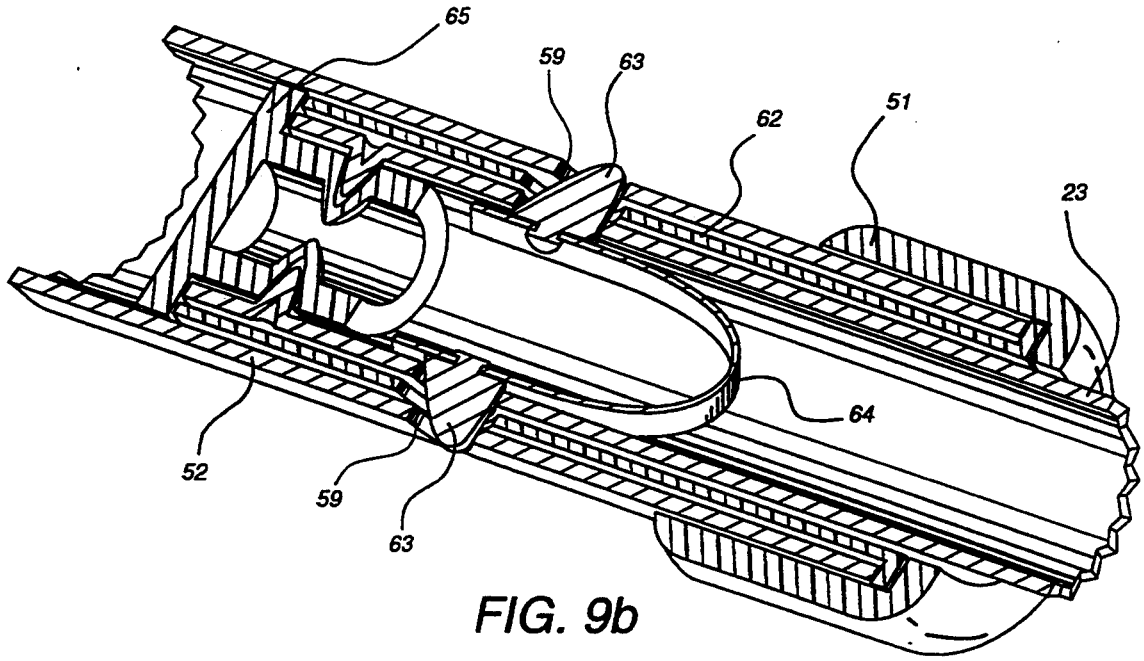
FIG. 9*b* is an enlarged partial cross section showing the telescopic tubing and locking mechanism.

FIG. 7 and FIG. 9*a* show the foam handgrip 21 attached to the plastic handle 22 by a friction fit. The plastic handle 22 is attached to one end of inner telescoping tube 23 by denting in the top and bottom of the inner telescoping tube 23 so that it deforms the plastic handle 22 and thus locks both parts together. Additionally, FIG. 9*b* shows that within the inner telescoping tube 23 is a U-shaped spring metal piece 64 attached to both catch buttons 63. Catch holes 59 are formed in the inner telescoping tube 23, in a tubular interior plastic spacer 62 and outer telescopic tube 52 so that when inner telescoping tube 23 is fully extended outwardly, the catch buttons 63 pop out through the holes and lock the outer tube 52 to the inner telescoping tube 23. To release the parts and telescope them together, the end of the foam handgrip 21 can be tapped, whereupon the catch button 63 recedes back into the end of the inner telescoping tube 23. This action occurs because of a camming surface on the catch buttons 63. The inner telescoping tube 23 can then be slid back into the garment bag 50 for compact storage, as seen in FIG. 4.

Figure 10A:
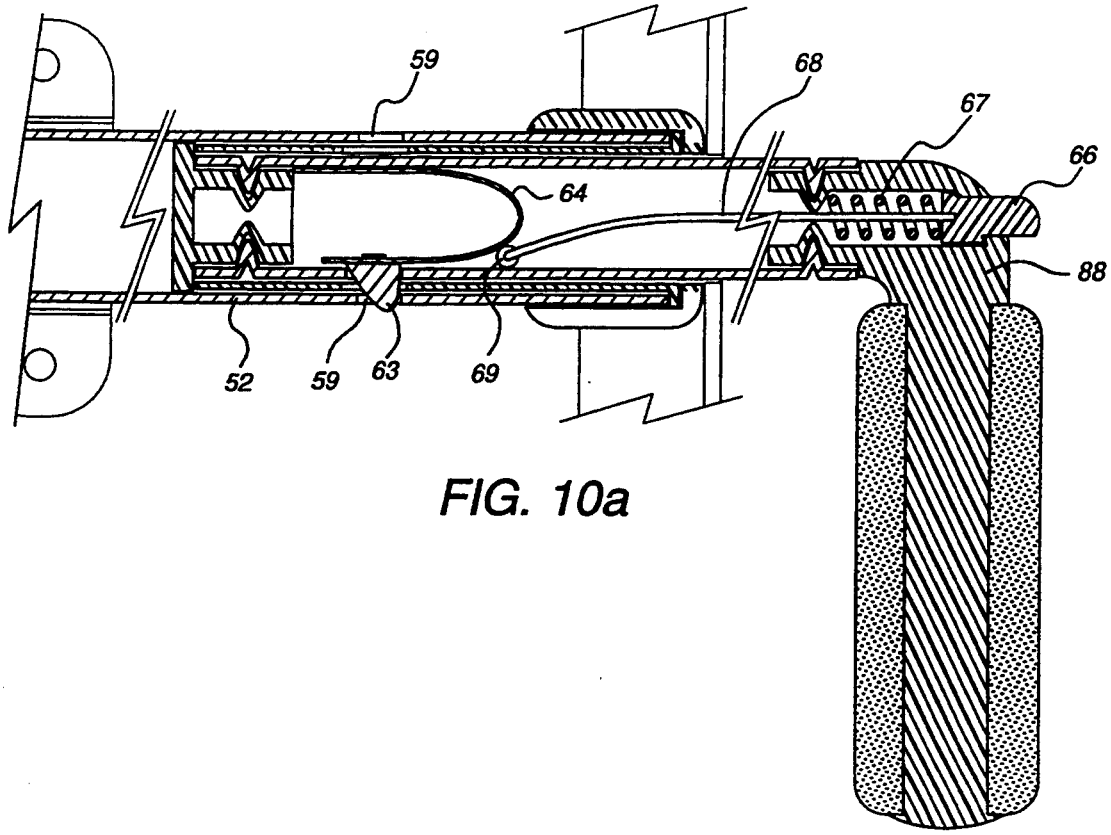
FIG. 10*a* is an enlarged partial cross section showing an alternative locking telescopic tubing and handle mechanism with a push button release.
Figure 10B:
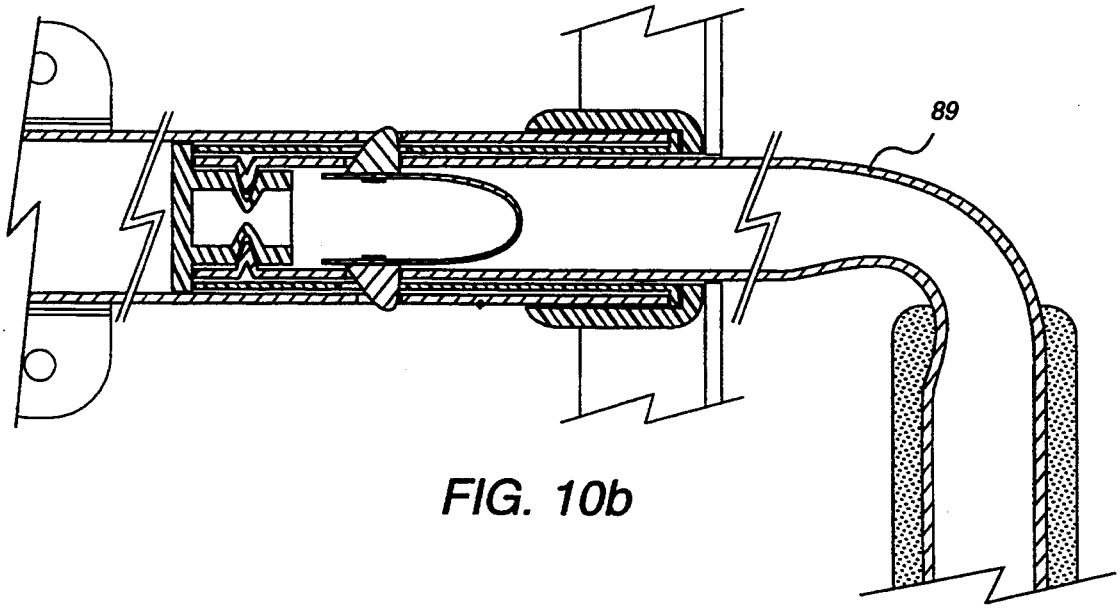
FIG. 10*b* is an enlarged partial cross section showing another alternative locking telescopic tubing that has a bend at one end to form a handle.

An alternative technique for releasing the catch buttons 63 from outer tube 52 is by way of a thumb operated push button 66 (FIG. 10*a*). Push button 66 moves in a hole in the plastic handle 88 and pushes against a catch release rod 68. The catch release rod 68 has at its other end a catch release roller 69 that pushes under spring member 64 and causes the catch button 63 to be withdrawn and disengaged from the outer telescopic tube 52. A coil spring 67 returns the thumb button 66 to an extended position when not being pressed. Yet another construction of the handle is shown in FIG. 10*b*. This handle construction is similar to that shown in FIG. 9*a*, except that the plastic handle 22 is eliminated and an inner telescoping tube 89 is bent with a crush bend to form a right angled handle. The advantage of this is that the cost of plastic handle 22 is eliminated, although the radius of the handle bend cannot be very small.

FIGS. 9*a* and 9*b* show that an interior end cap 65 is attached to the inner telescoping tube 23 in a swaged manner similar to the technique in which the plastic handle 22 is attached to the inner telescopic tube 23. This is accomplished by denting in the top and bottom of inner telescoping tube 23 so that it deforms end cap 65 and thus locks both pieces together. The end cap 65 provides a stop with respect to the interior plastic stop 62 when the inner telescoping tube 23 is fully pulled out. The end cap 65 abuts against the interior plastic spacer 62, which functions as a spacer between the inner telescoping tube 23 and the outer tube 52. The outer end of the interior plastic spacer 62 is flanged and held in place by an exterior plastic cap 51 that is attached by way of friction fit or adhesive to the outer telescoping tube 52. End cap 65 is carried with inner telescoping tube 23 during telescopic movements. The interior plastic spacer 62 and the exterior plastic cap 51 remain fixed at the end of outer telescoping tube 52.

Figure 8:
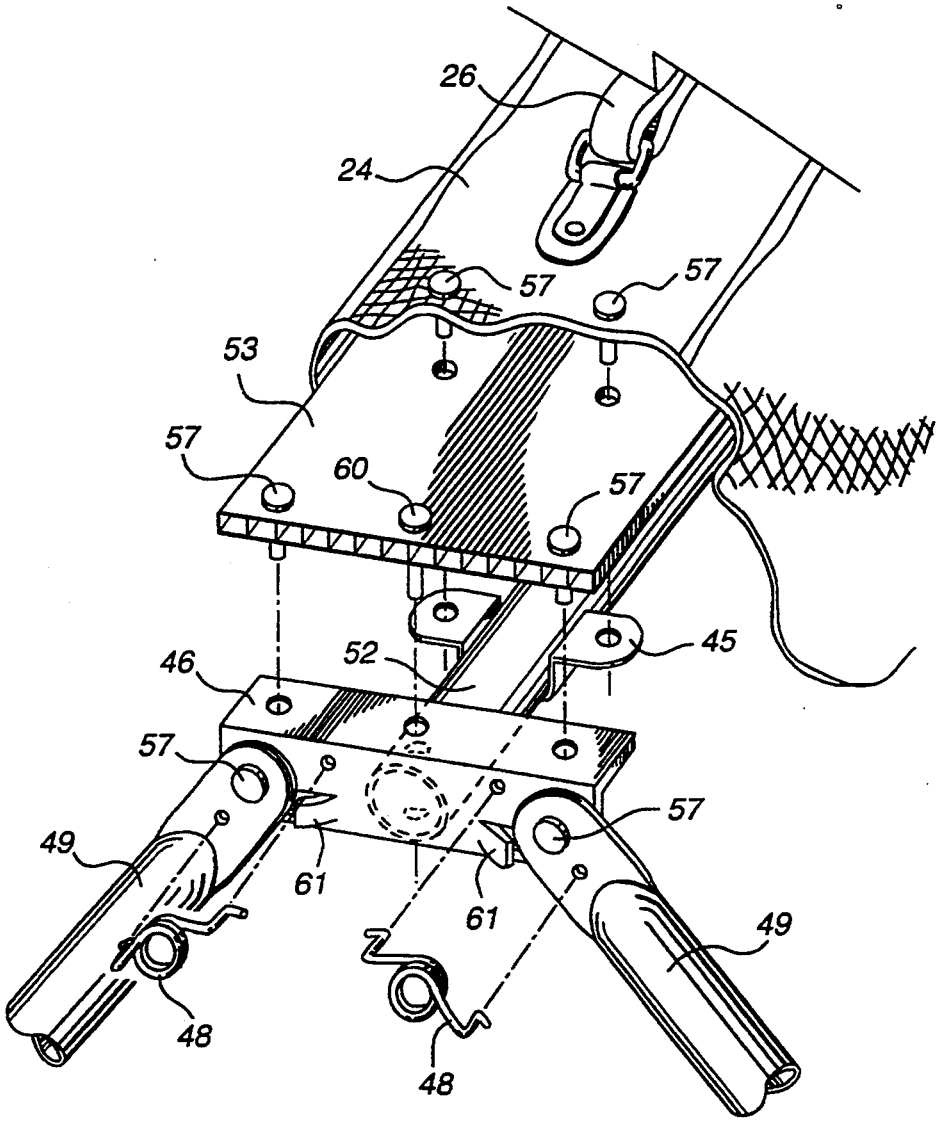
FIG. 8 is an enlarged exploded view showing a portion of the frame mechanism opposite the handle end.

FIGS. 7 and 8 illustrate a pair of support brackets 45 holding the outer telescoping tube 52 to each end of the stiffener plate 53. A number of rivets 57 are passed through the outer soft panel 24, the stiffener plate to secure the support brackets 45 thereto. The stiffener plate 53 can be constructed with extruded plastic with internal webs, as shown, or with wood, or a thin rigid metal. The stiffener plate 53 is also connected by rivets 57 at one end to a front angle bracket 47 (FIG. 7), and at the other end to a rear angle bracket 46. A long rivet 60 passes through the stiffener plate 53 and outer telescoping tube 52. Both the right and left tubular frame members 49 are connected to and pivot about the rear angle bracket 46 and the front angle bracket 47 via rivets 57.

An important feature of the garment bag 50 of the invention are the springs 48 that are engaged in holes in the right and left tubular frame members 49, and in holes in the angle bracket 46 (FIG. 8). Also provided are springs 48 that engage in holes in the right and left tubular frame members 49 and in holes in the front angle bracket 47 (FIG. 7). The springs 48 cause the right and left tubular frame members 49 to be spring biased apart from each other. The long end strap 29 limits the separation of the right and left tubular frame members 49, and thus the halves of the garment bag 50. When so configured, the garment bag 50 resembles the shape of an inverted V. As shown in FIG. 1, the wheels 27 are maintained apart when pulling the garment bag 50. By maintaining the wheels 27 spread apart, the garment bag 50 is prevented from tipping over and is made substantially more stable. The springs 48 are in a relaxed state when the garment bag 50 is in an unfolded or flat position (FIGS. 2, 3), but are in a loaded or tensioned state when the garment bag 50 is configured in an inverted V-shape (FIG. 1*a*), or in a compactly folded condition (FIG. 4).

Another important feature of the garment bag 50 is the provision of tubular frame stops 58 on the front angle bracket 47 (FIG. 7) and tubular frame stops 61 on the rear angle bracket 46 (FIG. 8). The stops 58 and 61 keep the tubular frames 49 from rotating inward too far, but do not limit outward rotation. The stops 58 and 61 are tabs that are stamped out of the angle brackets and engage the edges of the flattened ends of the tubular members 49 that are rotatably fastened to the respective angle brackets 46 and 47. By keeping the right and left structural frames 49 from rotating inwardly keeps the garment bag 50 maintained in an upright position and from leaning over to either side when being pulled by the foam handgrip 21. The garment bag 50 remains upright because the interior angle between the left and right tubular frame members 49 and either the front angle bracket 47 or rear angle bracket 46 cannot become less than approximately 90 degrees.

Figure 11:
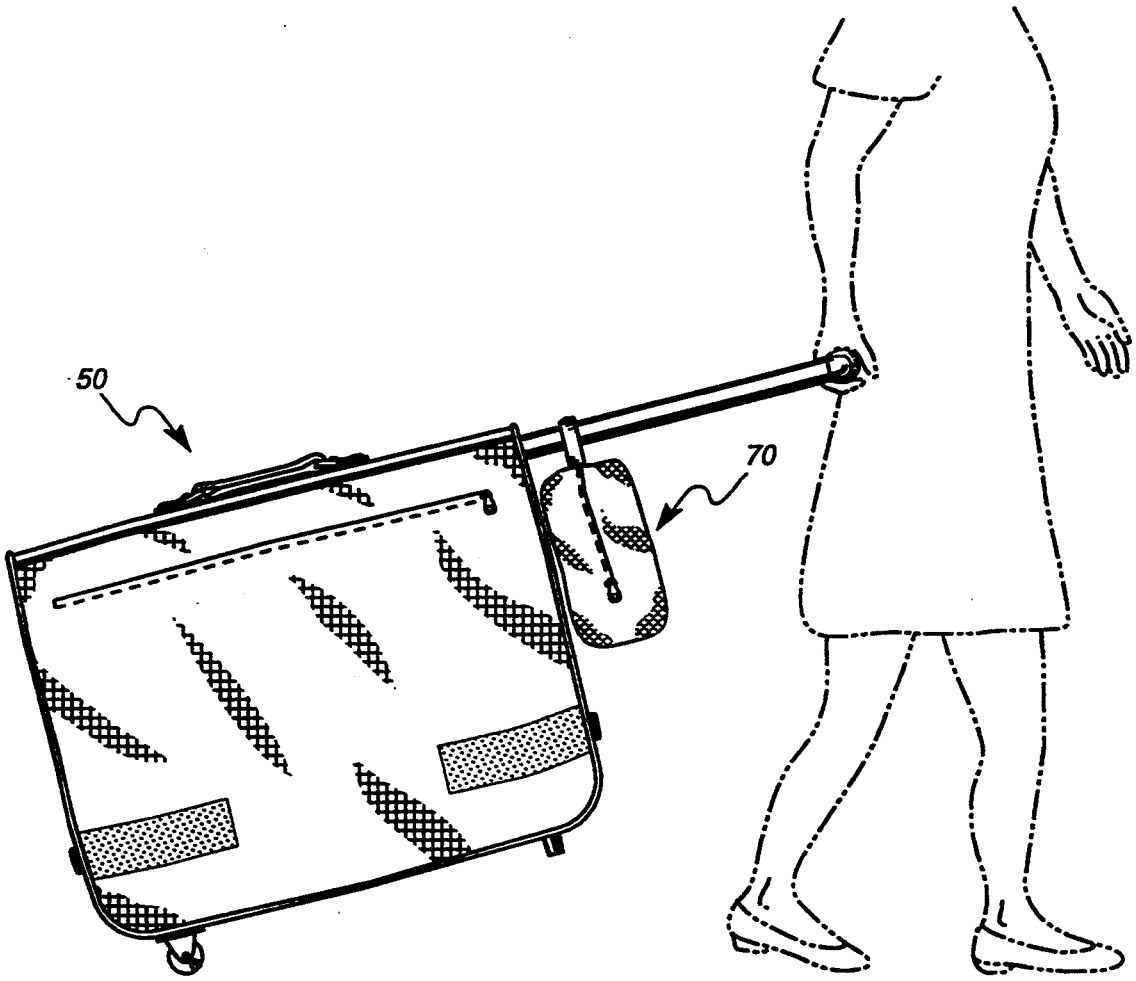
FIG. 11 is a side view showing how additional baggage can be securely carried with the garment bag of the invention.

An important feature of garment bag 50 is that it is a safe and low cost way to carry other baggage the traveler might be carrying. This is shown in FIG. 11. The handle of an additional bag 70 can be slipped over the foam grip 21 and suspended on the inner telescopic tube 23. This is advantageous because the garment bag 50 can carry additional baggage without having to add any additional parts, and prevents theft because the extra bag 70 would have to pass by the traveler's hand in order to be removed.

Figure 12:
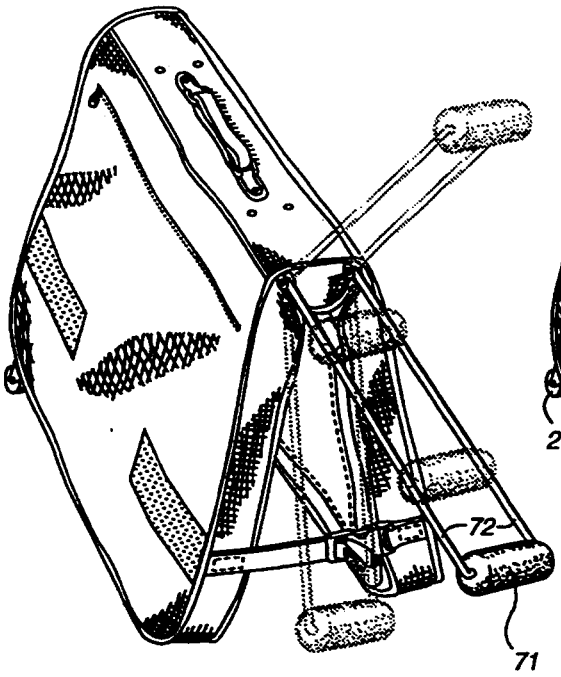
FIG. 12 is a perspective view of the folded garment bag in a partially opened position, showing an alternative handle mechanism.
Figure 13:
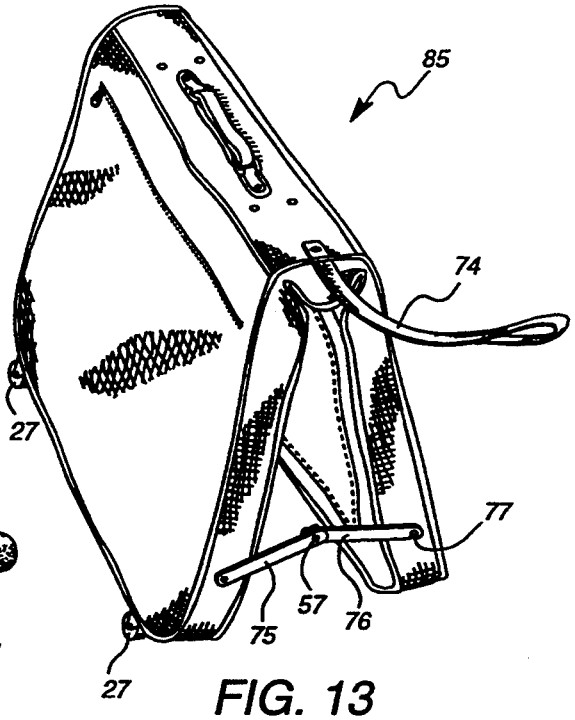
FIG. 13 is a perspective view of the folded garment bag in a partially opened position showing another alternative handle mechanism and end catch securing mechanism.
Figure 14:
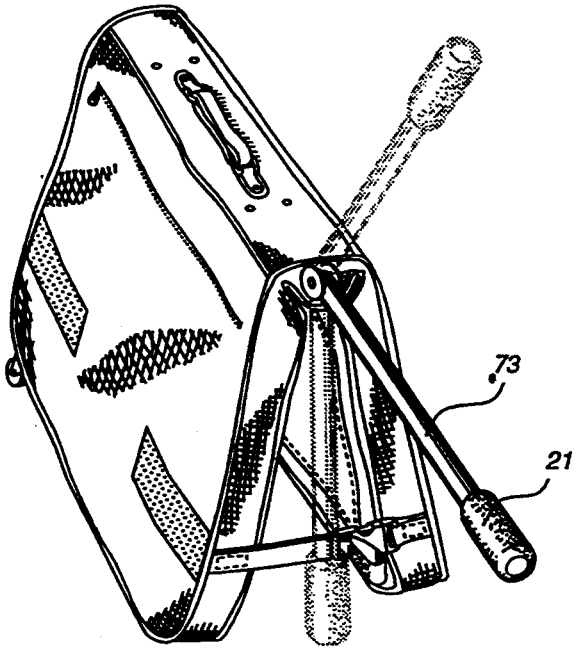
FIG. 14 is a perspective view of the folded garment bag in a partially opened position showing another alternative handle mechanism that is pivotally mounted outside the soft cover panel.

Other embodiments of handle devices are shown in FIGS. 12, 13, and 14. In FIG. 12, a double handle rod 72 with a foam handgrip 71 can either telescope out or rotate into a locked position. In FIG. 13, a pull strap 74 can be attached to the end of the garment bag 85 of the type that additionally requires four wheels instead of two. In FIG. 14, a handle tube 73 and associated foam grip 21 can rotate and lock into position to provide a handle mechanism.

Figure 15:
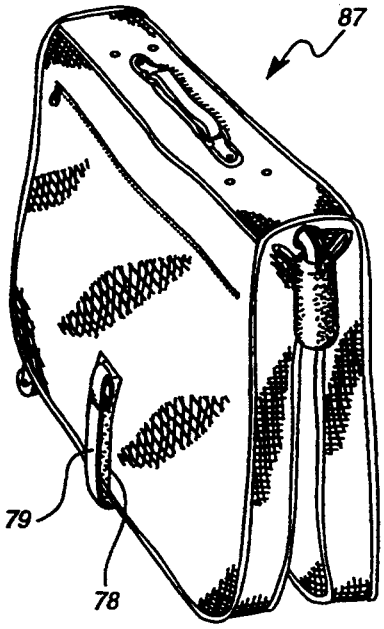
FIG. 15 is a perspective view of the folded garment bag in a closed storage position showing an alternative structure for the securing mechanism.

Other embodiments of mechanisms that can hold a garment bag in a variable but folded position are shown in FIG. 13 and 15. In FIG. 13, rigid brackets 75 and 76 are hinged together via a rivet 57, and connected to a detachable catch 77. In FIG. 15 a long middle strap 79 is placed around the bottom of the folded bag and connected to a Velcro fastener 78 that is fastened to the garment bag 87. This holds both halves of the garment bag 87 tightly for storage. When the end of the long middle strap 79 is detached from the Velcro fastener 78, the halves of the garment bag 87 are spring biased apart so that it can be pulled, similar to that show in FIG. 1.

Figure 16:
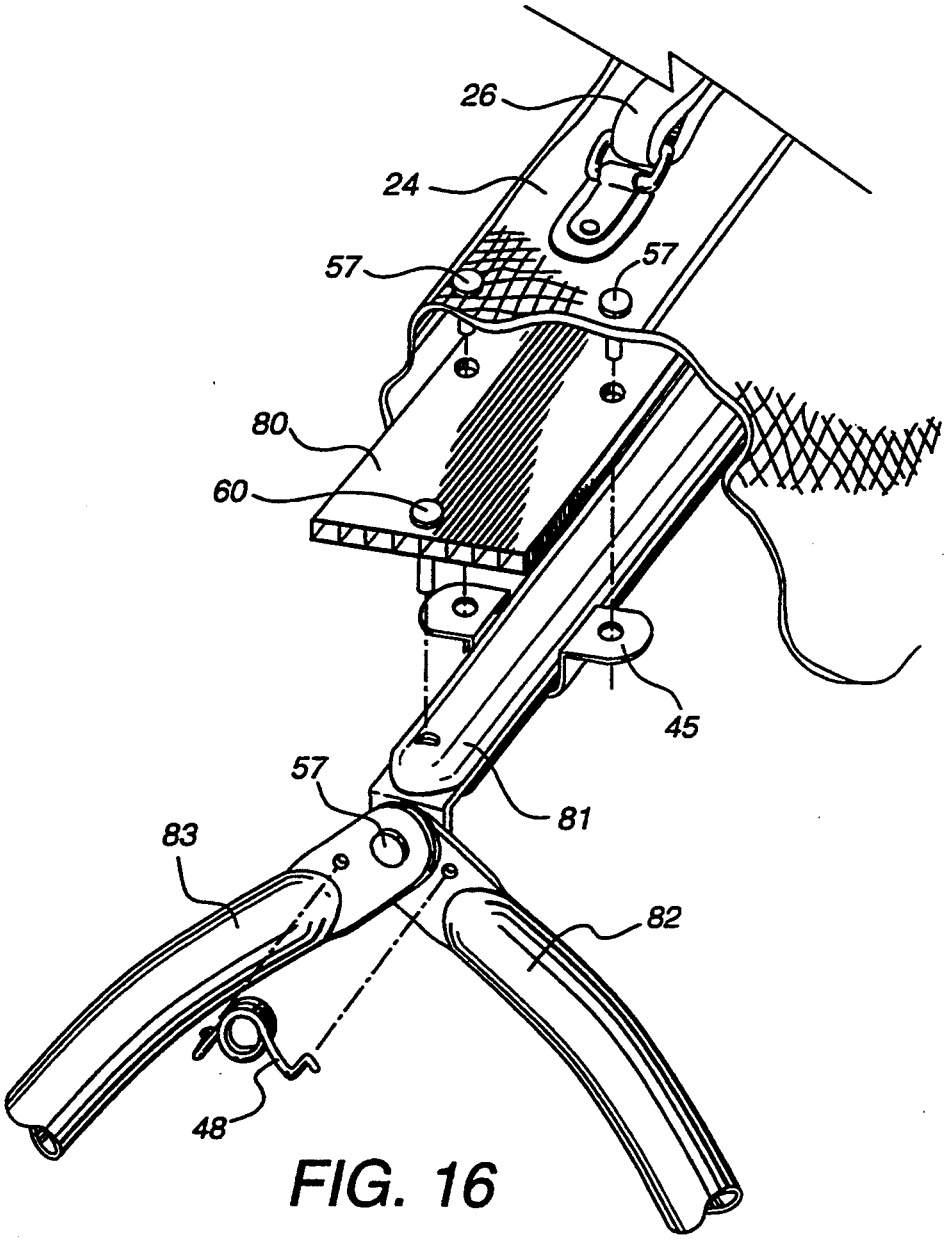
FIG. 16 is an enlarged exploded view showing an alternative frame mechanism opposite the handle end.

FIG. 16 illustrates an alternative way of connecting a right frame member with a curved bend 82 and a left frame with curved bend 83 to an outer tube with a flattened and angled end 81, via a rivet 57. Again, a support bracket 45 holds the outer tube with the angled end 81 to a narrow stiffener plate 80 and outer soft panel 24 with rivets 57. A spring 48 keeps the right frame with curved bend 82 and the, left frame with curved bend 83 biased apart for stable movement when pulling. This arrangement allows a lower unit cost of the garment bag, but with a more limited storage capacity. In this embodiment, the two springs 48 and the rear angle bracket 46 would be eliminated. Further, the size of the stiffener 53 would be modified so that it comprises a narrow stiffener 80.

The manner of using garment bag 50 of the invention is described below for a traveler departing from home and going to an airport. First, clothes and other items are packed into the garment bag 50, and then it is folded over in a conventional manner. The female plastic catch 30 and the male plastic catch 31 at the back edge of the garment bag 50 are then secured together. The springs 48 keep the long end straps 29 in tension and wheels 27 spread apart. This keeps the garment bag 50 upright and in a stable position for movement (FIG. 1*a*). Additionally, the tubular frame stops 58 and 61 are important in that they keep the garment bag 50 from leaning over from side to side while pulling it in a straight path, or while turning a corner.

The inner telescoping tube 23, the foam handgrip 21, and plastic handle 22 are then telescoped outwardly until stopped by the internal stops. The foam handgrip 21 is then rotated clockwise or counter-clockwise until spring button 63 pops out through catch holes 59, thus locking inner telescoping tube 23 to outer tube 52. This prevents the foam handgrip 21 and the plastic handle 22 from rotating in a horizontal position (FIG. 1*a*, 5, 6*a*, 9*a*, 11). The foam handgrip 21 can lock in two different horizontal positions 180 degrees apart. This makes it easier for the traveler to pull the garment bag, irrespective if the traveler is left or right handed (FIG. 1*a*, 3). Since either of these two handle positions forces the traveler to one side or the other of the garment bag 50, it helps keep the traveler's heels from coming into contact with the garment bag 50.

Additional baggage can be slipped over the foam handgrip 21 and the plastic handle 22 and rested on the inner telescoping tube 23 (FIG. 11). The traveler can then lift the foam handgrip 21 and pull the garment bag 50 in a direction of minimum width. Since the inner telescoping tube 23 is rigid, the garment bag 50 is not pulled into the traveler's heels.

For stowing the garment bag 50 in the trunk of a car, the traveler collapses the inner telescoping tube 23 back into the garment bag 50 by simply tapping inwardly on the foam handgrip 21. This causes the spring button 63 to become disengaged from the outer tube 52, thus allowing the inner telescoping tube 23 to be retracted. Additionally, the traveler can pull on the loops at the end of long end strap 29 and secure them to Velcro fastener 25 on both front and back sides of the garment bag 50. This action will close garment bag 50 into a tightly folded and compact position (FIG. 4).

Once at the airport, the traveler pulls on the loops at the end of both of the long end straps 29, thus releasing them from Velcro fasteners 25. Again, the springs 48 will bias apart both halves of the garment bag into an inverted V-shape, and place both of the long end straps 29 in tension. Both wheels 27 will also be spaced apart for stability when pulling the bag. The inner telescoping tube 23 is again pulled out and locked into place. The garment bag 50 can be pulled through the airport terminal, down the airplane aisle and to the traveler's seat where the inner telescoping tube 23 is collapsed and the garment bag 50 can be tightly folded together, strapped and, placed in an overhead bin.

Once the traveler arrives at a hotel, the male plastic catch 31 and the female plastic catch 30 are disengaged and the garment bag 50 can be unfolded and hung up by the hanger 39 in a closet.

Overall, the garment bag 50 is designed to provide a simple lightweight luggage device that may be carried on an airline and not checked, is only slightly larger than whatever contents it is holding, and be used to carry other pieces of luggage as well. In addition, the garment bag of the invention is economical and is easily pulled through crowded areas.

Although the present invention has been described above with a certain degree of particularity, it is understood that the present disclosure has been made by way of example, and changes in detail or structure such as replacing round tubing with square, or replacing plastic for metal, etc., may be made without departing from the spirit of the invention, as defined in the appended claims.

What is claimed is:

1. A method of manufacturing a garment bag arrangement, comprising the steps of:

fabricating a hinged frame structure for supporting a flexible garment enclosure that encloses and protects garments held therein when said enclosure is either folded or unfolded, said fabricating step including attaching a first section of the hinged frame structure to a first portion of the enclosure and attaching a second section of the hinged frame structure to a second portion of the enclosure so that the enclosure and the hinged frame structure can be folded together in a compact configuration and so that each said first and second portion of the enclosure is thus supported by the hinged frame structure;

providing means operable with said hinged frame structure for supporting the enclosure in a partially folded configuration so that the first portion of the folded enclosure is spaced from the second portion of the folded enclosure with a fold in the enclosure connecting the first and second portions together;

fastening at least one wheel to the first portion of the enclosure and fastening at least one wheel to the second portion of the enclosure, said wheels providing wheeled transportability of the enclosure; and fastening a handle to the garment bag arrangement so that the garment bag arrangement can be pulled.

2. The method of claim 1, further including constructing the hinged frame structure so as to be hinged about two parallel axes.

3. The method of claim 1, further including attaching at least one spring to the hinged frame structure to bias the first frame section away from the second frame section so that the frame sections resemble a V-shape.

4. The method of claim 3, further including limiting hinged rotation of said first and second frame sections with respect to each other to thereby maintain the V-shape when the garment bag arrangement is pulled around a corner.

5. The method of claim 1, further including fabricating the hinged frame structure so that the first section and the second section thereof can be hingedly rotated toward each other in a closed position so that a surface of the first portion of the enclosure fully contacts a surface of the second portion of the enclosure, whereby the enclosure is placed in the compact configuration for storage thereof.

6. A method of manufacturing a garment bag arrangement, comprising the steps of:

fabricating a hinged frame structure for supporting a flexible garment enclosure that encloses and protects garments held therein when said enclosure is either folded or unfolded, said fabricating step including attaching a first section of the hinged frame structure to a first portion of the enclosure and attaching a second section of the hinged frame structure to a second portion of the enclosure so that the enclosure and the hinged frame structure can be folded together in a compact configuration and so that each said first and second portions of the enclosure is thus supported by the hinged frame structure;

providing a spring member operable with the first section and the second section of said hinged frame structure for biasing apart the first portion of the enclosure with respect to the second portion so that the enclosure is partially folded;

providing a restraint member between said first portion and said second portion of the enclosure to limit an extent by which said first and second sections of the hinged frame structure are biased apart to thereby maintain said first and second portions in a spaced-apart and partially folded relationship for transportability of the enclosure;

fastening at least one wheel to the first portion of the enclosure and fastening at least one wheel to the second portion of the enclosure, said wheels providing wheeled transportability of the enclosure; and fastening a handle to the garment bag arrangement so that the garment bag arrangement can be pulled.

7. The method of claim 6, further including constructing the hinged frame structure so as to be hinged about two parallel axes.

8. The method of claim 6, further including attaching at least one spring to the hinged frame structure to bias the first frame section away from the second frame section so that the frame sections resemble a V-shape.

9. The method of claim 8, further including limiting hinged rotation of said first and second frame sections to thereby maintain the V-shape when the garment bag arrangement is pulled around a corner.

10. The method of claim 6, further including fabricating the hinged frame structure so that the first section and the second section thereof can be hingedly rotated toward each other in a closed position so that a surface of the first portion of the enclosure fully contacts a surface of the second portion of the enclosure, whereby the enclosure is placed in the compact configuration for storage thereof.

* * * * *